US011242166B2

(12) United States Patent
Belbecir

(10) Patent No.: US 11,242,166 B2
(45) Date of Patent: Feb. 8, 2022

(54) MACHINE FOR PRODUCING CAPSULES CONTAINING A PRODUCT TO BE MIXED WITH A LIQUID, IN PARTICULAR BY MEANS OF A PERCOLATOR DEVICE

(71) Applicant: Bilel Belbecir, Neuville sur Saone (FR)

(72) Inventor: Bilel Belbecir, Neuville sur Saone (FR)

( * ) Notice: Subject to any disclaimer, the term of this patent is extended or adjusted under 35 U.S.C. 154(b) by 105 days.

(21) Appl. No.: 16/319,990

(22) PCT Filed: Jul. 28, 2017

(86) PCT No.: PCT/IB2017/054611
§ 371 (c)(1),
(2) Date: Jan. 23, 2019

(87) PCT Pub. No.: WO2018/025136
PCT Pub. Date: Feb. 8, 2018

(65) Prior Publication Data

US 2019/0225357 A1 Jul. 25, 2019

(30) Foreign Application Priority Data

Aug. 4, 2016 (FR) ..... 1657583

(51) Int. Cl.
*B65B 29/00* (2006.01)
*B65B 29/02* (2006.01)
(Continued)

(52) U.S. Cl.
CPC ..... *B65B 29/022* (2017.08); *B65B 1/02* (2013.01); *B65B 1/04* (2013.01); *B65B 1/24* (2013.01); *B65B 7/2842* (2013.01); *B65B 29/06* (2013.01)

(58) Field of Classification Search
CPC ..... B65B 29/00; B65B 29/02; B65B 29/022; B65B 29/025; B65B 29/06; B65B 1/00;
(Continued)

(56) References Cited

U.S. PATENT DOCUMENTS 3,527,020 A * 9/1970 Mancini ..... B65B 7/16 53/282
3,618,642 A 11/1971 Beaulieu
(Continued)

FOREIGN PATENT DOCUMENTS

WO 2009080383 A1 7/2009
WO 2012145854 A1 11/2012

OTHER PUBLICATIONS

Preliminary Search Report for Patent Application FR 1657583 dated Apr. 13, 2017, Republic of France.
(Continued)

*Primary Examiner* — Chelsea E Stinson
(74) *Attorney, Agent, or Firm* — M&B IP Analysts, LLC

(57) ABSTRACT

The machine (1) in question comprises a dispensing module (6) and a unit (9) for applying lids (3).
According to the invention, the machine (I) comprises:
- a rotary plate (5) having cavities (12);
- a unit (7) for delivering shells (2) of capsules to a cavity (12), comprising a storage magazine (15) for storing the shells (2) stacked together, and a sub-assembly (20-24) for delivering shells (2) one by one to the plate (5), by gravity;
- a unit (8) for filling a shell (2) with product, comprising a funnel (16) facing which an empty shell (2) placed in a cavity (12) of the plate (5) is positioned by rotating said plate (5).

7 Claims, 9 Drawing Sheets

(51) Int. Cl.

| | |
|---|---|
| ***B65B 1/02*** | (2006.01) |
| ***B65B 1/04*** | (2006.01) |
| ***B65B 1/24*** | (2006.01) |
| ***B65B 7/28*** | (2006.01) |
| ***B65B 29/06*** | (2006.01) |

(58) Field of Classification Search
CPC B65B 1/02; B65B 1/04; B65B 7/2842; B65B 43/50; B65D 85/8046
USPC ..... 53/529
See application file for complete search history.

(56) References Cited

U.S. PATENT DOCUMENTS

| | | | | |
|---|---|---|---|---|
| 5,890,349 | A * | 4/1999 | Heisler | B65B 7/2842 53/485 |
| 2013/0318928 | A1 | 12/2013 | Dakis | |
| 2016/0152356 | A1 * | 6/2016 | Rubbi | B65B 63/022 53/473 |
| 2017/0210499 | A1 * | 7/2017 | Jensen | B65B 65/00 |

OTHER PUBLICATIONS

The International Search Report for PCT/IB2017/054611 dated Sep. 12, 2017, EPO.

* cited by examiner

MACHINE FOR PRODUCING CAPSULES CONTAINING A PRODUCT TO BE MIXED WITH A LIQUID, IN PARTICULAR BY MEANS OF A PERCOLATOR DEVICE

The present invention relates to a machine for producing capsules containing a product to be mixed with a liquid, in particular by means of a percolator device.

These capsules are in particular intended to be used in a percolator device making it possible to produce coffee drinks.

It will be understood that the term "capsule" refers to a sealed package, hermetically or not, which comprises a shell receiving the product and a lid that may or may not be pre-pierced for closing said shell, the lid being able to be pierced by the percolating device during production of a coffee drink, for example. Such a capsule is also frequently called "pod". Such a capsule may be used to contain an edible product, such as coffee or chocolate, as well as a nonedible product, such as shower gel.

BACKGROUND OF THE INVENTION

Percolating machines for producing coffee drinks are widespread among individuals after a sales policy by the manufacturers of such machines, consisting of selling the machines at relatively low prices, but making their main profits on the sale of the capsules. Using such a machine on a daily basis may therefore prove expensive. Furthermore, the capsules are often made from aluminum or other materials that are not very environmentally friendly, since they are expensive to manufacture and expensive to recycle.

OBJECTS OF THE INVENTION

The present invention aims to resolve these essential drawbacks.

One main aim of the invention is therefore to provide a machine for manufacturing such capsules, which allows an individual to produce his own capsules and thus achieve substantial savings.

Another aim of the invention is to provide more environmentally friendly capsules, i.e., the component material of which is less expensive and easily recyclable.

SUMMARY OF THE INVENTION

The machine in question uses capsules, each of which comprises a shell for receiving the product, forming a peripheral upper rim, and a lid for closing the shell, connected to said rim; the machine comprises, in a manner known in itself, a module for dispensing the product and a unit for applying lids on the shells of the capsules.

According to the invention, the machine comprises a rotary plate having cavities regularly distributed over its circumference, each cavity being able to receive a shell of a capsule and keep said shell in position on the plate; the cavities of the plate are arranged such that, when one cavity is positioned opposite said unit for applying lids, another cavity is situated opposite a unit for delivering shells of capsules comprised by the machine, still another cavity is situated opposite a unit for filling a cavity with product, and at least one other cavity still is situated opposite a free sector of the plate, making it possible to remove a capsule opposite a cavity of the plate;

said unit for delivering capsule shells is situated upstream relative to the dispensing module in the direction of rotation of the plate; it comprises a storage magazine for storing the shells stacked together, and a subassembly for delivering shells one by one to the plate, by gravity, such that a single shell is delivered in a cavity of the plate located below the storage magazine;

a filling unit is situated opposite a trough for delivering product, comprised by the dispensing module; it comprises a funnel opposite which an empty shell placed in a cavity of the plate is positioned by rotation of said plate;

the machine comprises means for driving the rotation of the plate with cavities; and the machine comprises an automaton for coordinating these driving means with driving means of said subassembly for delivering the shells, with means for controlling the operation of the dispensing module, and means for controlling the application of lids on the shells of the capsules.

During the use of the machine, the automaton detects the positioning of a cavity opposite said storage magazine such that said cavity is capable of receiving said bottom shell delivered by said delivery subassembly; if a cavity is not positioned opposite the storage magazine, the automaton actuates the rotation of the plate until a cavity is positioned opposite the storage magazine; the automaton next actuates said delivery subassembly so as to release a shell, which falls by gravity into the cavity situated below it.

The automaton then commands the rotation of the plate until the shell in question is brought opposite the lower opening of the funnel comprised by the filling unit; the dispensing module is next actuated so as to deliver an appropriate dose of product, which falls by gravity into the funnel, then into the capsule.

The automaton next commands an additional rotation of the plate until the shell in question is brought opposite the lid application unit, then commands the operation of said unit so as to apply a lid on said shell, to form the capsule.

The automaton next commands additional pivoting of the plate, making it possible to bring said capsule opposite said free sector of the plate, at which said capsule can be removed from the cavity of the plate.

The user can thus, owing to this machine, produce its own capsules and achieve substantial savings. Furthermore, because these capsules have not been transported and stored, they can be made from a material that is not as strong as aluminum, in particular plastic for the shell and an appropriate film for the lid.

Preferably, said delivery subassembly comprises a part movable in a to-and-fro movement situated at the lower end of the storage magazine; this moving part forms, at one end, a receiving opening coming, in an initial position of the moving part, across from a bottom opening of the storage magazine and receiving the bottom shell from the series of shells contained in the storage magazine, said bottom shell falling into said receiving opening by gravity, and the rim of said bottom shell being received against two receiving surfaces formed by the moving part, situated on two opposite sides of the moving part and parallel to the movement direction of said moving part; the moving part also forms a first guide rail situated in the plane of said receiving surfaces of the moving part, which communicates with a release opening for releasing said lower shell, situated at the other end of the moving part; the moving part also forms two side ramps, the lower parts of which are arranged on the side of said receiving opening, above the beginning of said first guide rail, these ramps being situated on two opposite sides of the moving part and being parallel to the movement direction of said moving part, so as to be able to engage below the peripheral upper rim formed by the shell that is immediately above said bottom shell, these ramps communicating with a second guide rail situated above said first guide rail; during the movement of the moving part from said initial position, the ramps make it possible to lift the series of shells situated in the storage magazine, so as to provide for the separation of said immediately higher shell with respect to said bottom shell; when the moving part arrives in a final position in which said release opening arrives opposite the opening of the storage magazine, said bottom shell falls by gravity into a cavity of the plate, through said release opening, while said immediately higher shell is retained by rims of the moving part delimiting the bottom part of said second guide rail;

said drive means of the delivery subassembly drive said moving part in a to-and-fro movement of said moving part, such that said moving part moves from said initial position, for receiving the bottom shell, into said final position, then returns from said final position to said initial position.

Preferably, the filling unit comprises a compacting member moving in a to-and-fro motion coaxially to the funnel, through the bottom opening of the funnel and to the inside of the shell.

Thus, when the product is powdered, the compacting member makes it possible to compact said product in the shell.

Preferably, in this case of a compacting member, the machine comprises a sleeve coaxial to the bottom opening of the aforementioned funnel, said sleeve being movable along the axis of said funnel between an upper position in which its bottom end is at a distance from the plate and does not hinder the rotational movement of said plate, and therefore allows a capsule shell to arrive opposite the bottom opening of the funnel, and a lower position in which said lower end of the sleeve bears against the rim comprised by said shell and thus constitutes a continuous conduit from the inside of the sleeve to the inside of the shell; and said compacting member is movable through the sleeve.

Said sleeve makes it perfectly possible to hold the shell during the compacting of the product done by the compacting member and makes it possible to avoid any risk of overflow of the product past the rim of the shell during this compacting.

Preferably, the lid application unit comprises a body movable relative to a support structure, this mobility being done along a travel slightly larger than the diameter of the rim of a shell, this travel extending between a beginning of application position for a lid and an end of application position for a lid; this moving body comprises, mounted on it:

a support film for supporting the lids, these lids being self-adhesive and placed one after the other on said film;

a stepwise advancement wheel for the stepwise advancement of the film, the stepwise advancement of which is coordinated with the movement of said moving body;

an edge around which the film is engaged, such that the sliding of the film around said edge causes a lid to be loosened with respect to the film; and immediately adjacent said edge, an applicator for application of the lid on the peripheral upper rim of the shell.

In practice, the shell is positioned relative to the lid application unit such that a front zone of its peripheral upper edge is located, when the moving body is in said beginning of application position, immediately below said edge; the moving body is next moved toward said end of application position, this movement causing pivoting of said wheel and therefore sliding of the film around said edge, which causes gradual loosening of a lid with respect to the film, over the course of this movement; the lid becomes stuck on the rim of the shell located immediately below the edge and is applied on this rim by said applicator member, also over the course of said movement.

Preferably, the lid application unit comprises a moving body and movement rail, the rail allowing a movement between an initial position, a beginning of application position of a lid and an end of application position of a lid; the moving body comprises, mounted thereon:

a support film for supporting the lids, said lids being self-adhesive and placed one after the others on this film;

a first wheel and a second wheel for advancing the film stepwise, the stepwise advancement of which is coordinated with the movement of said moving body;

a set of drive means for driving the rail and the wheels;

a set of guide means for guiding the film, and a moving part around which the film is engaged, such that the sliding of the film around this moving part causes the loosening of a lid with respect to the film.

In practice, the unit moves forward along its rail to position itself above a shell. The moving part and the guide elements of the film make it possible to position and loosen the lid from the tape and place it over the course of the movement on the edges of the shell. The torque of the drive means of the wheels is identical during the movement to position it above the shell, but is different during the application of the lid.

Preferably, the cavities of the plate emerge in the periphery of said plate, which facilitates the removal of the capsules with respect to said cavities, either manually or by a mechanical device.

The machine may include a control and management unit, comprising a memory in which a computer program is stored for remotely controlling the machine, in particular making it possible to consult the number of capsules produced, to manage the inventories of capsules and to save and use a configuration profile by types of capsules produced.

The invention will be better understood, and other features and advantages thereof will appear, in reference to the appended schematic drawing, showing, as a non-limiting example, one preferred embodiment of the machine to which it relates.

DESCRIPTION OF THE PREFERRED EMBODIMENTS

Figure 1:
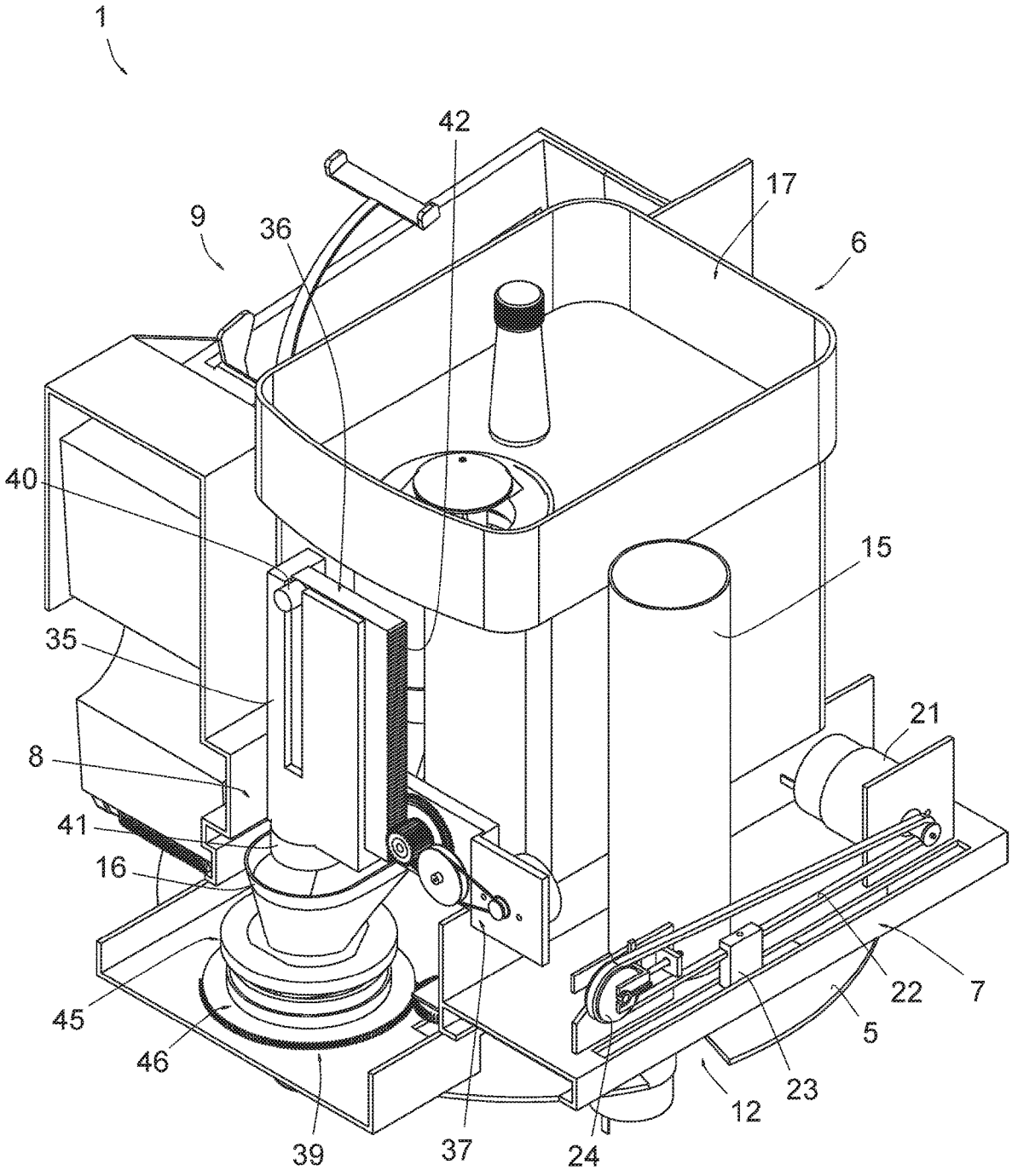
FIG. 1 is a perspective view of said machine, from a viewing angle situated above the machine.
Figure 2:
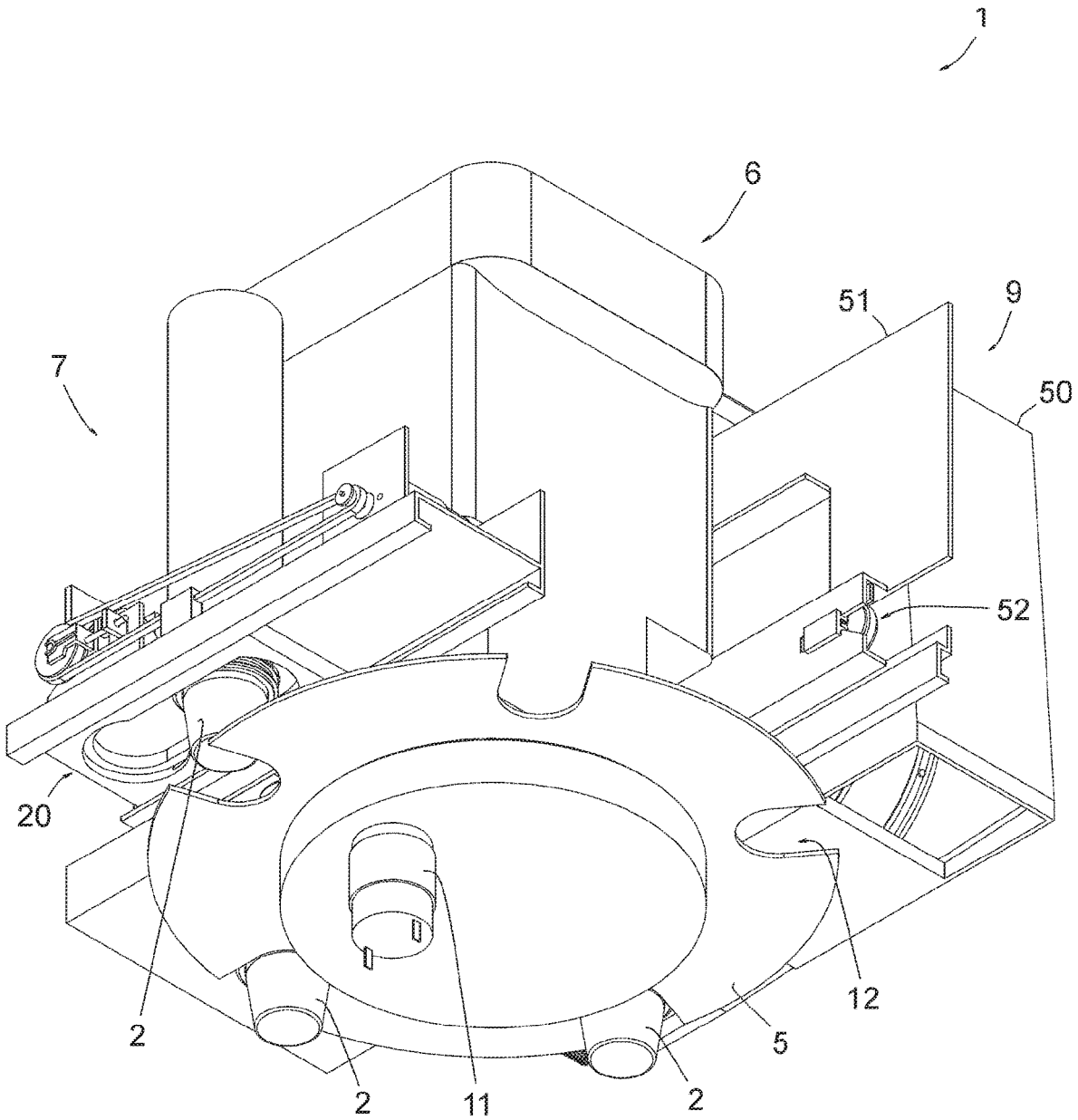
FIG. 2 is a perspective view from a viewing angle situated below the machine.
Figure 3:
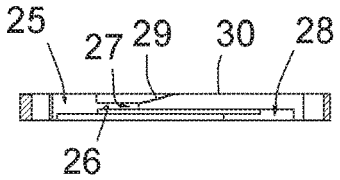
FIG. 3 is a longitudinal sectional view of a moving part comprised by the unit for delivering capsule shells belonging to said machine.
Figure 7:
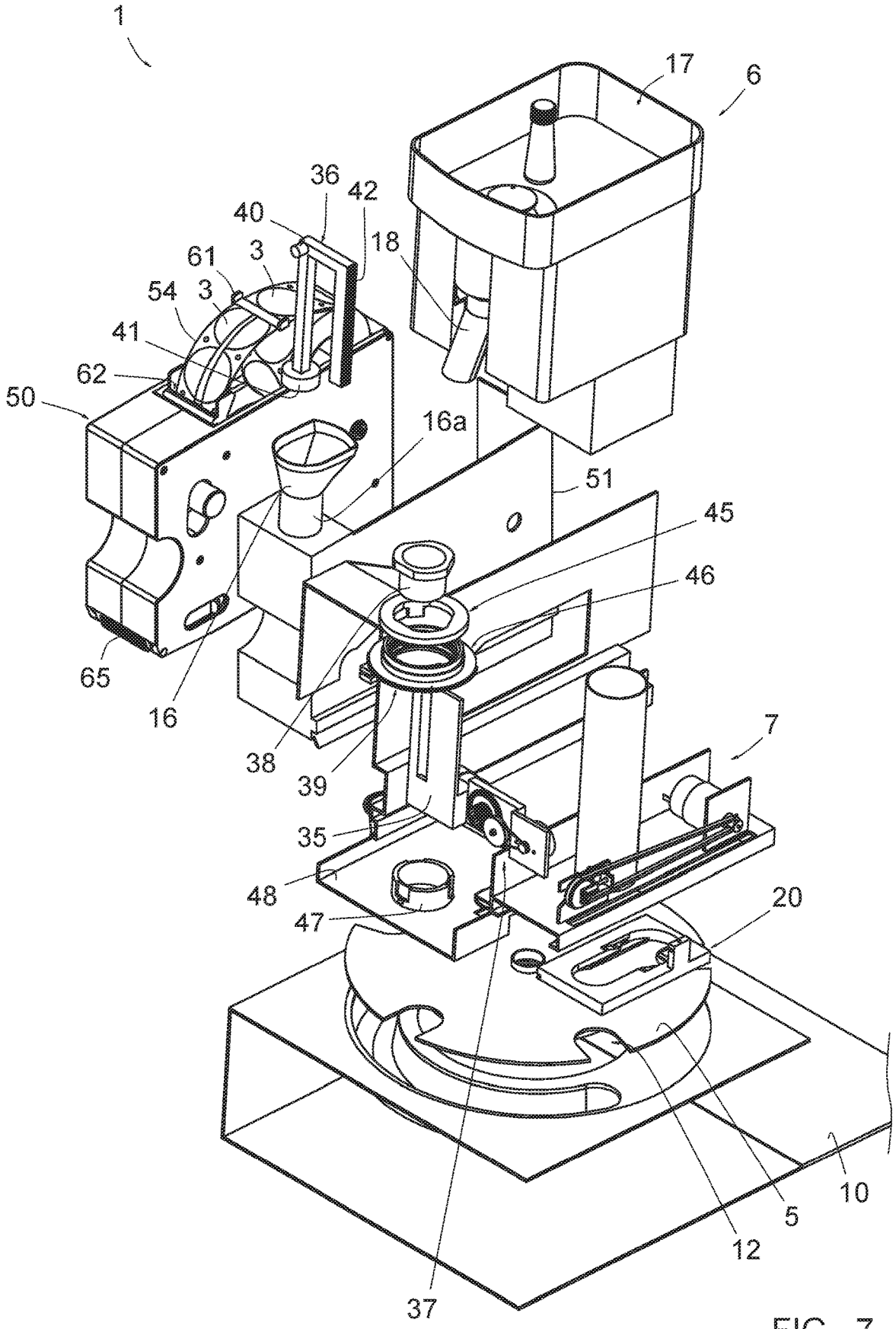
FIG. 7 is an exploded perspective view of the machine, making it possible to outline different parts making up a filling unit of the capsule shells and compacting of a coffee powder in said shells.

FIGS. 1, 2 and 7 show a machine 1 for producing capsules intended to be used by a percolator device making it possible to produce coffee drinks, such a device commonly being called "coffee maker".

The term "capsule" refers to a hermetically sealed package, which comprises a shell 2 for receiving ground coffee and a lid 3 for hermetically sealing said shell (see FIG. 12), the lid 3 being intended to be pierced by the percolator device when making a coffee drink. Such capsules also frequently called "pods". Each shell 2 forms a peripheral upper rim on which a lid 3 is intended to be applied.

The machine 1 comprises a rotary plate 5, a coffee grinder 6, a shell 2 delivery unit 7, a filling and compacting unit 8 and a lid application unit 9.

The plate 5 is mounted rotating on a lower chassis 10 and is rotated by a motor 11 (see FIG. 2). As shown in FIG. 2, it has five cavities 12 regularly distributed over its circumference, emerging in the periphery of said plate. Each cavity 12 has a width slightly larger than the diameter of the body of the shell 2 but smaller than the diameter of the peripheral upper rim of said shell, such that it is able to receive said body through it and said rim is received against the plate 5, the shell 2 thus being kept in position on the plate.

As also visible in FIG. 2, the cavities 12 are arranged such that, when a cavity 12 is positioned opposite a lid application zone comprised by said lid application unit 9, another cavity 12 is situated opposite a tubular storage magazine 15 containing shells 2, comprised by the shell delivery unit 7, another cavity 12 is situated opposite a funnel 16 comprised by the filling and compacting unit 8, and two other cavities 12 are situated opposite a free sector of the plate 5, behind the grinder 6, making it possible to remove a capsule from a cavity 12.

The grinder 6 is of the traditional type; it comprises a tray 17 for receiving coffee beans to be ground and a trough 18 (see FIG. 7) for delivering ground coffee powder to the funnel 16.

The unit 7 for delivering shells 2 is situated upstream relative to the grinder 6 in the rotation direction of the plate 5; it comprises the storage magazine 15 for storing shells 2 stacked together, and a subassembly for delivery to the plate of the shells 2 one by one, by gravity. This subassembly comprises a moving part 20 situated at the bottom end of the storage magazine 15, a motor 21, a belt 22 connected to an extension 23 formed by the part 20, and a wheel 24 borne by a base comprised by the unit 7, the belt 22 being engaged on the output pinion of the motor 21 and on the wheel 24. The motor 21 is able to be driven alternatingly in one rotation direction and in the opposite rotation direction, such that it drives the part 20 in a to-and-fro movement.

Figure 4:
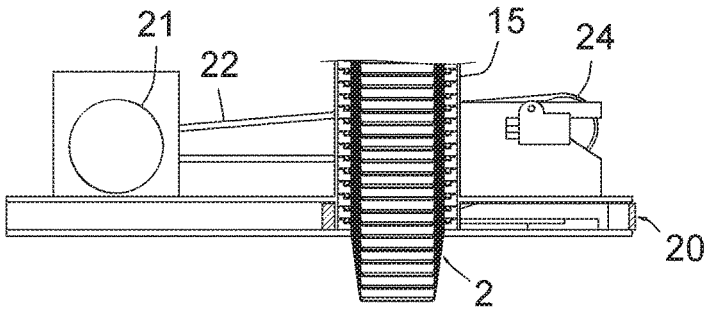
FIGS. 4 to 6 are views of said unit for delivering capsule shells in longitudinal section passing through the axis of a series of capsule shells, respectively in an initial position of said moving part, in an intermediate position of said moving part and in a final position of said moving part.

As shown in FIGS. 2 to 6, the part 20 forms, at one end, a receiving opening 25 coming, in an initial position of the moving part 20 shown in FIGS. 2 and 4, opposite the lower opening of the storage magazine 15 and receiving the bottom shell 2 of the series of shells contained in the storage magazine 15; said bottom shell 2 falls by gravity into said receiving opening 25. The peripheral upper rim of said bottom shell 2 is received against two receiving surfaces 26 formed by the part 20, situated on two opposite sides of the part 20 and which are parallel to the movement direction of said part. The part 20 also forms a first guide rail 27 situated in the plane of said receiving surfaces 26, which communicates with a release opening 28 of said bottom shell 2, situated at the other end of the part 20. The part 20 also forms two side ramps 29, the bottom parts of which are arranged on the side of said receiving opening 25, above the start of said first guide rail 27, these ramps 29 being situated on two opposite sides of the part 20 and being parallel to the movement direction of said part 20. They are situated at a height of the part 20 such that they are able to engage below the peripheral upper rim formed by the shell 2 that is immediately above said bottom shell 2 in the storage magazine 15. These ramps 29 communicate with a second guide rail 30 situated above said first guide rail 27.

Figure 5:
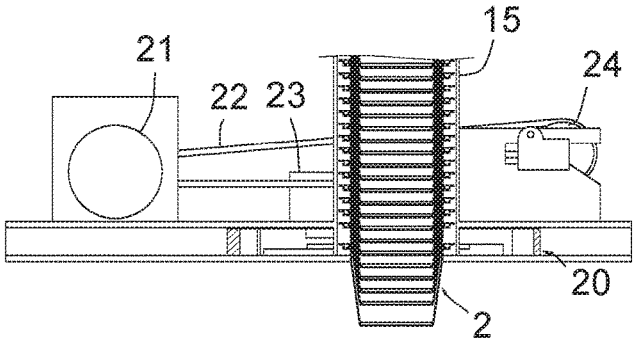
Figure 6:
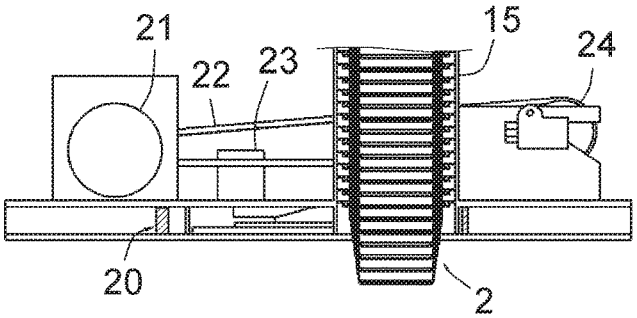

The part 20 is movable from the initial position shown in FIG. 4, in which the receiving opening 25 is opposite the bottom opening of the storage magazine 15, the bottom shell 2 falling by gravity into said receiving opening 25. From this initial position, the part 20 is moved to the left in FIGS. 5 and 6; during this movement, the ramps 29 engage below the upper rim of said immediately higher shell and, during this movement, lift the series of shells 2 situated in the storage magazine 15, so as to unstick said immediately higher shell 2 with respect to said bottom shell 2, as shown in FIG. 5; during the arrival of the part 20 in the final position shown in FIG. 6, in which said release opening 28 comes across from the opening of the storage magazine 15, said bottom shell 2 (which is no longer shown in FIG. 6) falls by gravity into the cavity 12 of the plate 5, through said release opening 28, while said immediately higher shell 2 is retained by rims of the moving part delimiting the second guide rail 30.

During the return of the part 20 into said initial position, said shell 2 will fall against the surfaces 26 by gravity and a new delivery cycle of said shell 2 into the following cavity 12 may begin again.

As shown more particularly in FIGS. 1 and 7, the filling unit 8 of the shells 2 and compacting of the coffee powder in said shells 2 comprises, aside from the funnel 16, a guide chassis 35 for guiding the compacting member 36, a subassembly 37 for vertical movement of said member 36, a lower sleeve 38 and a subassembly 39 for vertical movement of said sleeve 38.

Figure 8:
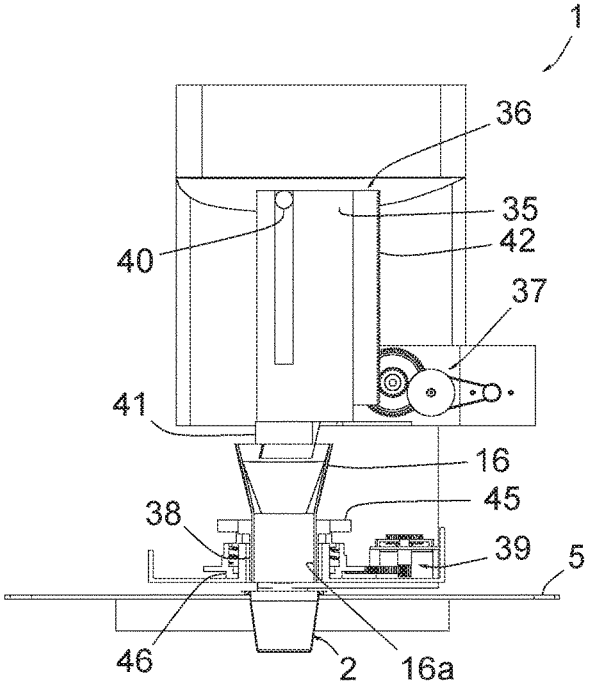
FIGS. 8 to 10 are views of said unit from the front, during three successive phases for filling a shell with coffee powder and compacting said coffee powder in said shell.
Figure 9:
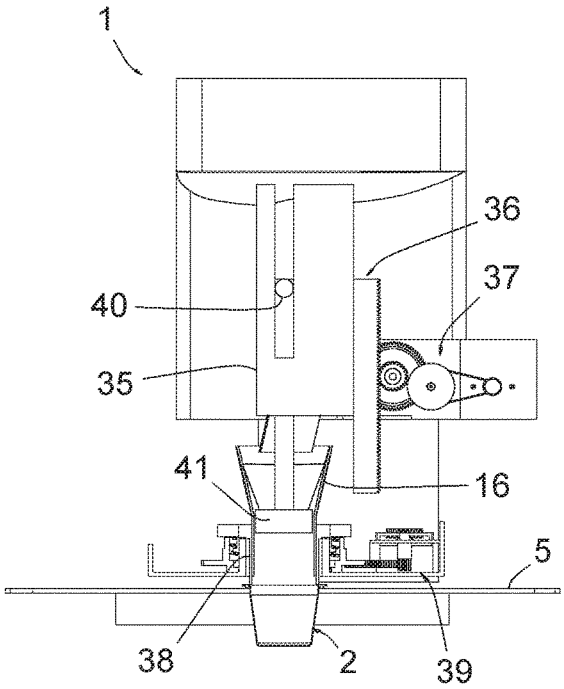
Figure 10:
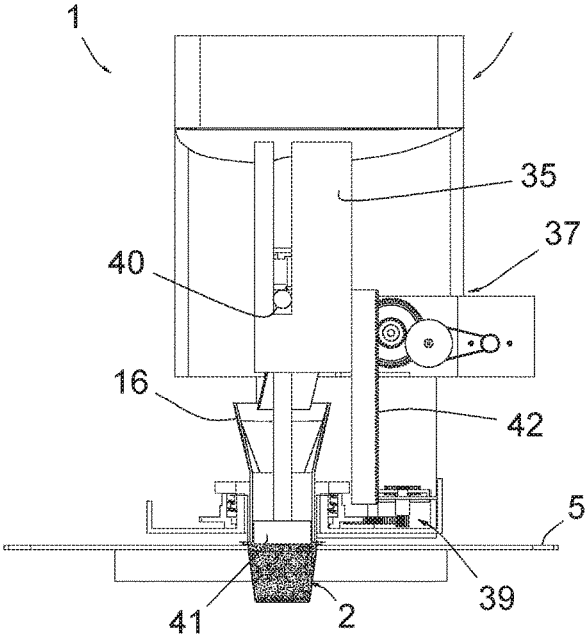

As shown, the funnel 16 forms a tubular bottom portion **16*a* (see FIG. 7) positioned, in the assembly state, withdrawn from the plate 5, as visible in FIGS. 8 to 10**.

The chassis 35 forms a vertical guide rail in which a stud 40 slides secured to the compacting member 36. The latter is thus guided in sliding relative to this chassis 35.

The compacting member 36, aside from the stud 40, has an inverted U-shaped body, one branch of which comprises a compacting head 41 at its bottom end and the other branch of which forms a side rack 42.

The subassembly 37 comprises a motor and a transmission connecting said motor to the rack 42. The motor is able to be driven in one rotation direction and the opposite direction, such that said motor acts on the compacting member 36 in a to-and-fro movement, between a withdrawn position of the head 41, shown in FIG. 1 and FIG. 8, and a compacting position, shown in FIG. 10.

As shown in FIG. 7, the sleeve 38 comprises a noncircular upper part engaged on a receiving ring 45 of said sleeve, belonging to the subassembly 39. Said ring 45 is internal relative to an outer ring 46 also belonging to the subassembly 39; the inner ring 45 is engaged on a shroud 47 secured to a base 48 comprised by the unit 8, and comprises inner radial protrusions engaging slidingly in radially outer recesses comprised by said shroud 47. The ring 45 is thus translatable relative to the shroud 47 while being wedged in rotation relative thereto.

The inner ring 45 further comprises an outer thread engaging with an inner thread arranged in the outer ring 46, and the latter comprises a lower collar that has outer teeth, secured to it, the teeth of said collar engaging with a transmission that comprises the subassembly 39. This transmission is engaged with a motor (not shown in FIGS. 1 and 7), which is able to be driven in one rotation direction and the opposite direction.

It will thus be understood that the rotation of the ring 46 makes it possible to produce a vertical translation of the inner ring 45-sleeve 38 assembly.

As shown in FIGS. 8 to 10, in the assembly state, the sleeve 38 is engaged around the lower tubular portion 16*a* of the funnel 16. FIG. 8 shows the sleeve 38 in an upper position relative to the plate 5, in which the lower end of said sleeve is at a distance from the plate 5 and does not hinder the rotational movement of said plate, thus allowing a shell 2 to come opposite the lower opening of the tubular portion 16*a* of the funnel 16.

FIG. 9 shows a lower position of the sleeve 38 resulting from rotational driving of the ring 46, in which the lower end of the sleeve 38 bears against the upper peripheral rim comprised by the shell 2 situated below the funnel 16, which makes it possible to form a continuous conduit from the inside of the sleeve 38 to the inside of the shell 2. In this lower position of the sleeve 38, a dose of ground coffee is delivered by the trough 18 and falls into the shell 2 by gravity, without overflow owing to the contact of the sleeve 38 with the rim of the shell 2.

The compacting member 36 is next driven downward to the position shown in FIG. 10 in which the head 41 that it comprises performs compacting of the coffee powder present in the shell 2, also without overflow owing to the contact of the sleeve 38 with the upper rim of the shell 2.

Figure 11:
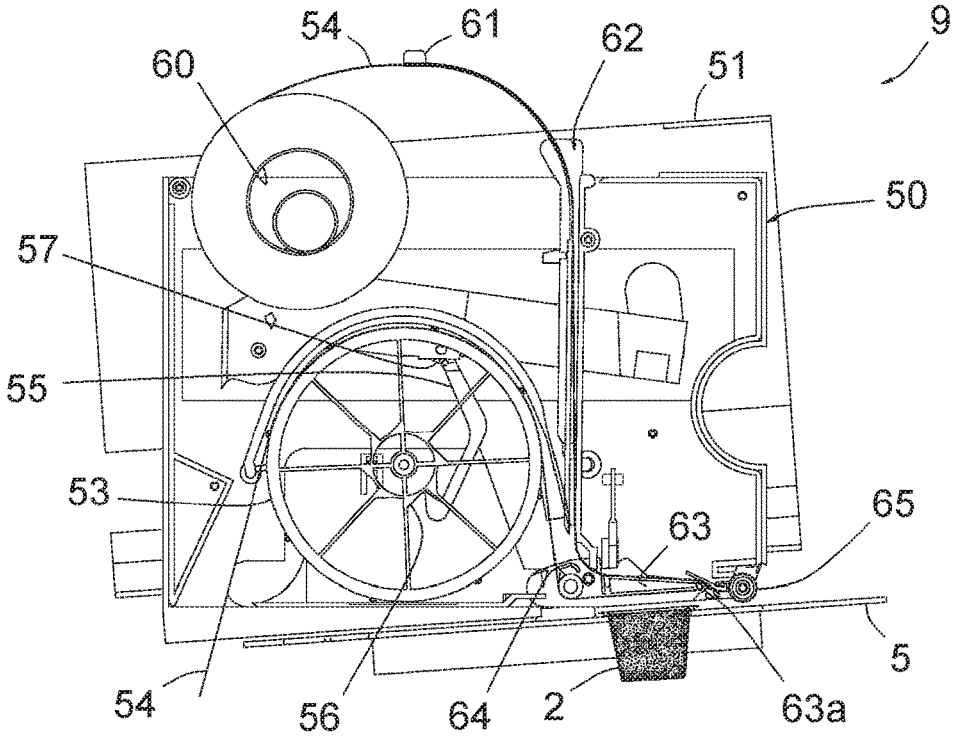
FIGS. 11 to 13 are sectional views of the unit for applying lids, respectively in a beginning of application position of a lid, an intermediate position and an end of application position of the lid.
Figure 12:
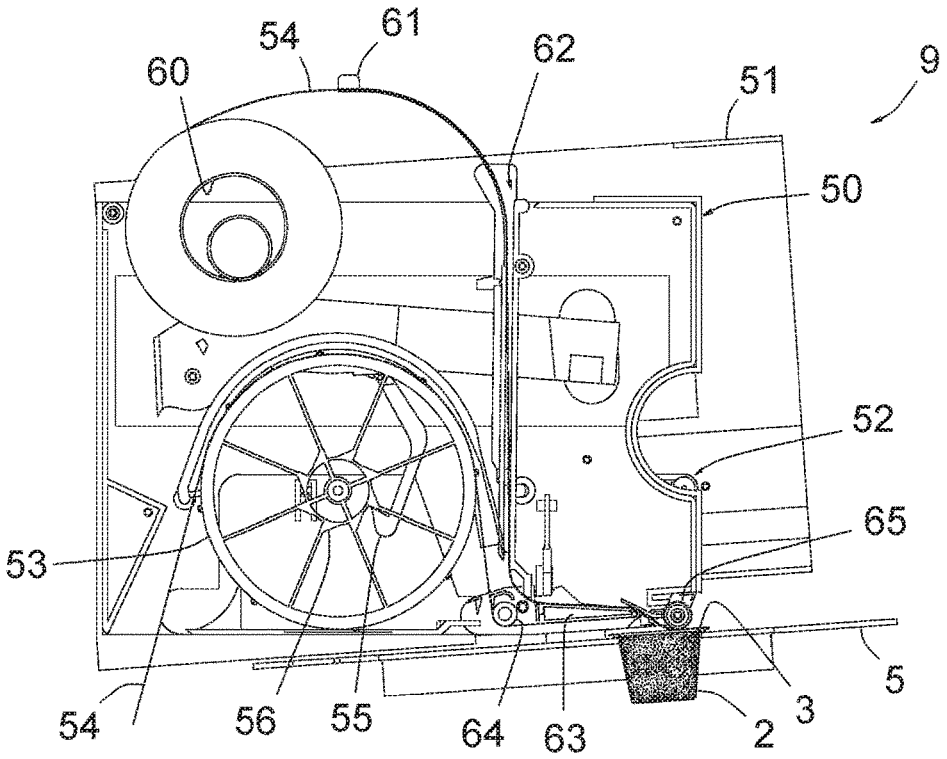
Figure 13:
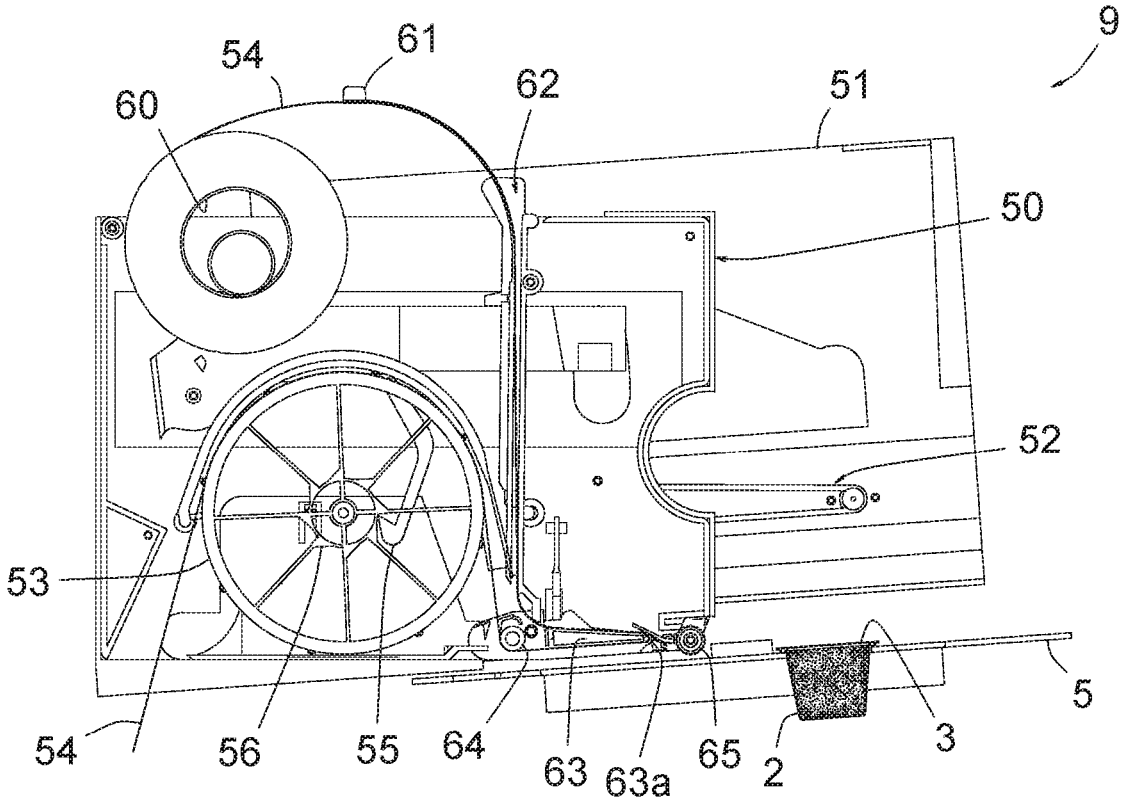
Figure 14:
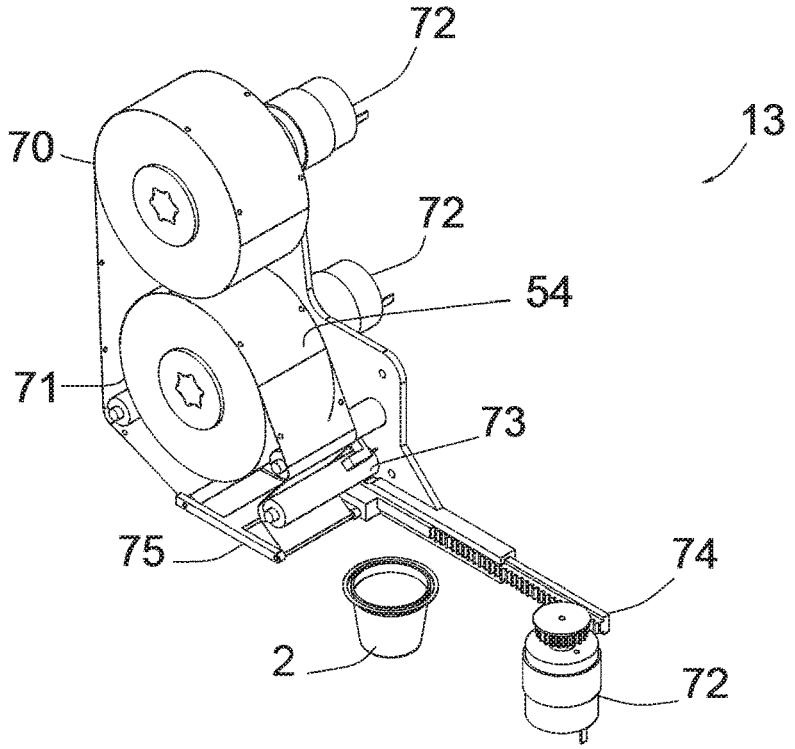
FIGS. 14 to 17 are views of another embodiment of a lid application unit, respectively in a starting position, a beginning of application position of the lid, an intermediate position and an end of application position of a lid.

FIGS. 11 to 13 show the unit 9 for applying lids 3, which comprises a body 50 movable relative to a fixed support structure 51. As shown by comparison of FIGS. 11 to 13, this mobility is done, while the disc 5 and therefore the shell 2 are immobile, between a beginning of application position of the lid 3, shown in FIG. 11, and an end of application position of the lid 3, shown in FIG. 13, going through a plurality of intermediate positions, one of which is shown in FIG. 12. The movement of the body 50 relative to the structure 51 is done using a drive assembly 52 including a motor, a belt and a pulley similar to those already described with respect to the unit 7. The pulley is of the ratchet type and is shown on the rotation shaft of a wheel 53 with stepwise advancement of a film 54 supporting the lids 3 one after the other. The ratchet-type pulley refers to a pulley that is rotatably engaged with the shaft of the wheel 53 in one rotation direction but that is freely rotating relative to said shaft in the opposite rotation direction; using this pulley, the assembly 52 drives the pivoting of the wheel 53 when the body 50 is moved relative to the structure 51 from the position shown in FIG. 11 to the position shown in FIG. 13, but leaves this wheel 53 immobile when the body 50 is moved in the opposite direction to return to the position shown in FIG. 11 from the position shown in FIG. 13.

The film 54 is engaged around the wheel 53 and comprises, between the lids 3, holes (shown in FIG. 7) allowing it to engage with corresponding radial spurs comprised by the wheel 53.

The wheel 53 is associated with a pivoting part 55 that is hook-shaped, mounted pivoting on the body 50 by a base end (situated on the top in FIGS. 11 to 13) and forming a flat and a contact edge at its free end. This free end is located close to ramps 56 formed by the wheel 53 on the side of the hub of said wheel. The hook-shaped part 55 is returned by a spring 57 in a pivoting position going toward the left in FIGS. 11 to 13.

The ramps 56 are arranged on rays formed by the wheel 53. Each of them comprises a tilted anterior wall, oriented in a radially outer direction of the wheel 53, and a substantially posterior wall, separated from the anterior wall by an edge. It is understood that the terms "anterior" and "posterior" are defined relative to the rotation direction of the wheel 53, which is counterclockwise as this wheel is seen in FIGS. 11 to 13.

During the pivoting of the wheel 53 in this counterclockwise direction, the anterior wall of the ramp 56, against which the contact edge of the hook-shaped part 55 bears, makes this hook-shaped part pivot to the right in FIGS. 11 to 13, stretching the spring 57, until this contact edge passes beyond the edge separating the anterior wall and the posterior wall of the ramp 56; the flat formed by the hook-shaped part 55 then bears against the posterior wall of the ramp 56; this flat is slightly angulated relative to said wall, such that the hook-shaped part 55, returned by the spring 57, imparts a supplemental counterclockwise rotation force to the wheel 53, providing the proper tensioning of the film 54 around said wheel.

The body 50 also comprises, mounted on it, a shroud 60 for receiving a spool of film 54, a support 61 for supporting the film 54, forming a slot for engagement of said film (see FIG. 7) and guiding the latter in a conduit 62, a part 63 for loosening of the lids 3, forming an edge 63*a* around which the film 54 is engaged, such that this sliding of the film 54 around said edge 63*a* causes the loosening of a lid 3 with respect to the film 54, a roller 64 for returning the film 54 around the wheel 53, and, opposite the edge 63*a*, a roller 65 for applying a lid 3 on the rim of the shell 2 situated below it.

Each lid 3 is adhered removably on the film 54, which is made from silicone paper. The lids 3 are adhered one after the other on said film 54.

In practice, as shown in FIG. 11, the shell 2 is positioned relative to the unit 9 such that an interior zone of its peripheral edge is situated, when the body 50 is in the beginning of application position shown in this figure, immediately below the edge 63*a*; the moving body is next moved toward said end of application position, this movement causing pivoting of the wheel 53 and therefore sliding of the film 54 around the edge 63*a*, which causes gradual loosening of a lid 3 with respect to the film 54, over the course of this movement; the lid 3 is adhered on the rim of the shell 2 situated immediately below the edge 63*a* and is applied on said rim by the roller 65, also over the course of said movement.

Figure 15:
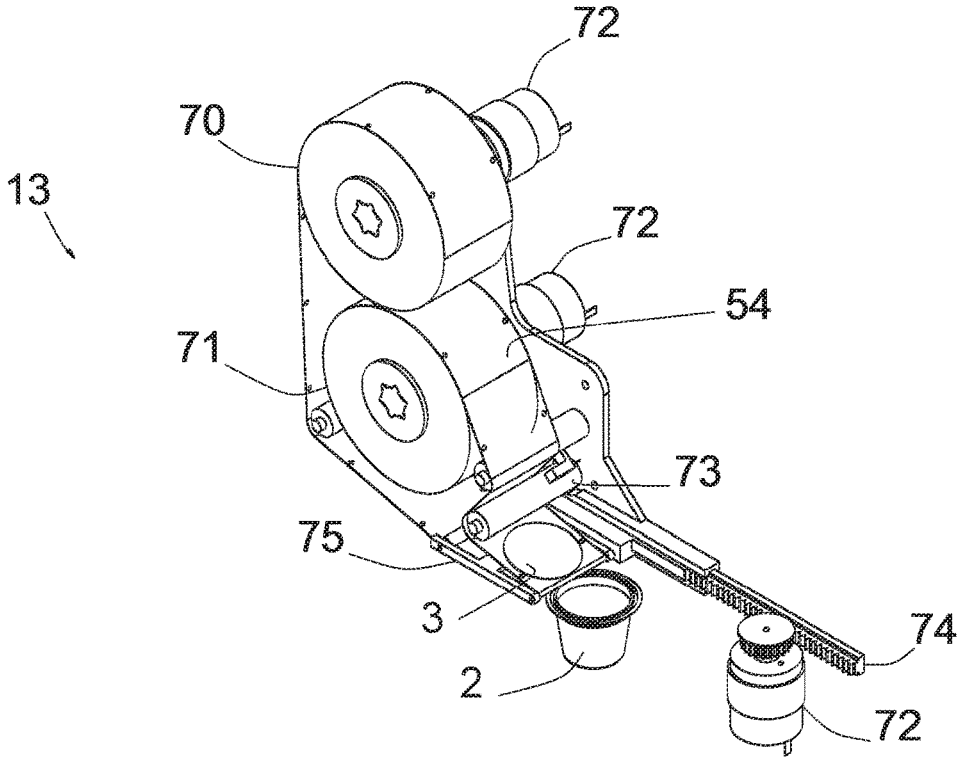
Figure 16:
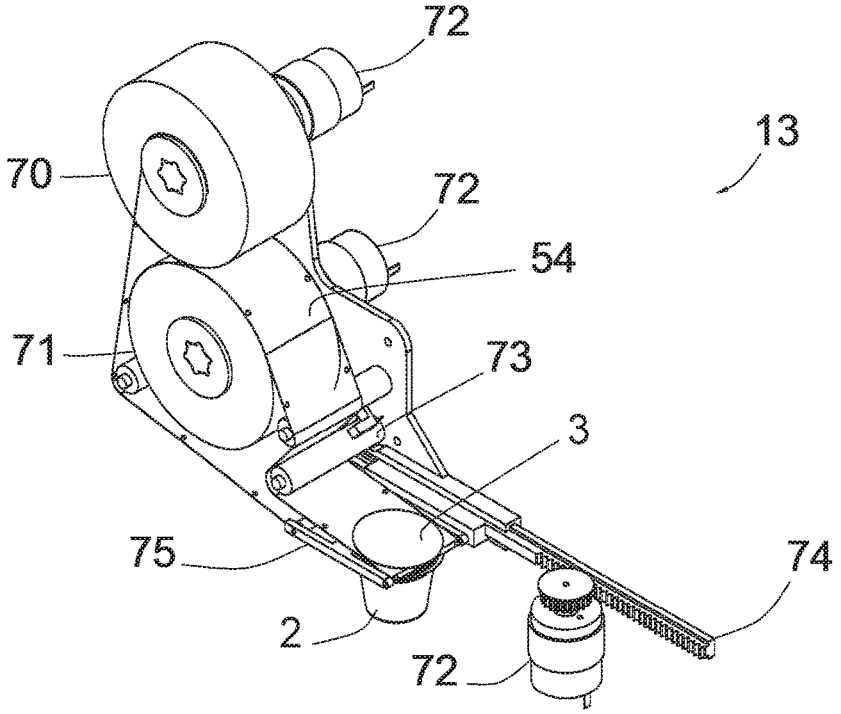

FIGS. 14 to 17 show another embodiment of the lid application unit 3. The lid application unit 13 comprises a body movable relative to a movement rail 74. As shown by comparing FIGS. 14 to 17, this mobility is done between a beginning of application position of a lid 3, shown in FIG. 15, and an end of application position of the lid 3, shown in FIG. 17, by way of a plurality of intermediate positions, one of which is shown in FIG. 16. The movement of the moving body is done using a movement rail 74 using a drive means 72. The moving body comprises a first wheel 70 rotated by a second drive means 72, a second wheel 71 rotated by a third drive means 72, a set of guide elements 73 of the film 54 and a moving part 75.

The film 54 is engaged around wheels 70 and 71, and comprises, between the lids 3, holes allowing it to engage with corresponding radial spurs comprised by the wheel 70 and the wheel 71.

Each lid 3 is adhered removably on the film 54, which is made from silicone paper. The lids 3 are adhered one after the other on said film 54.

Figure 17:
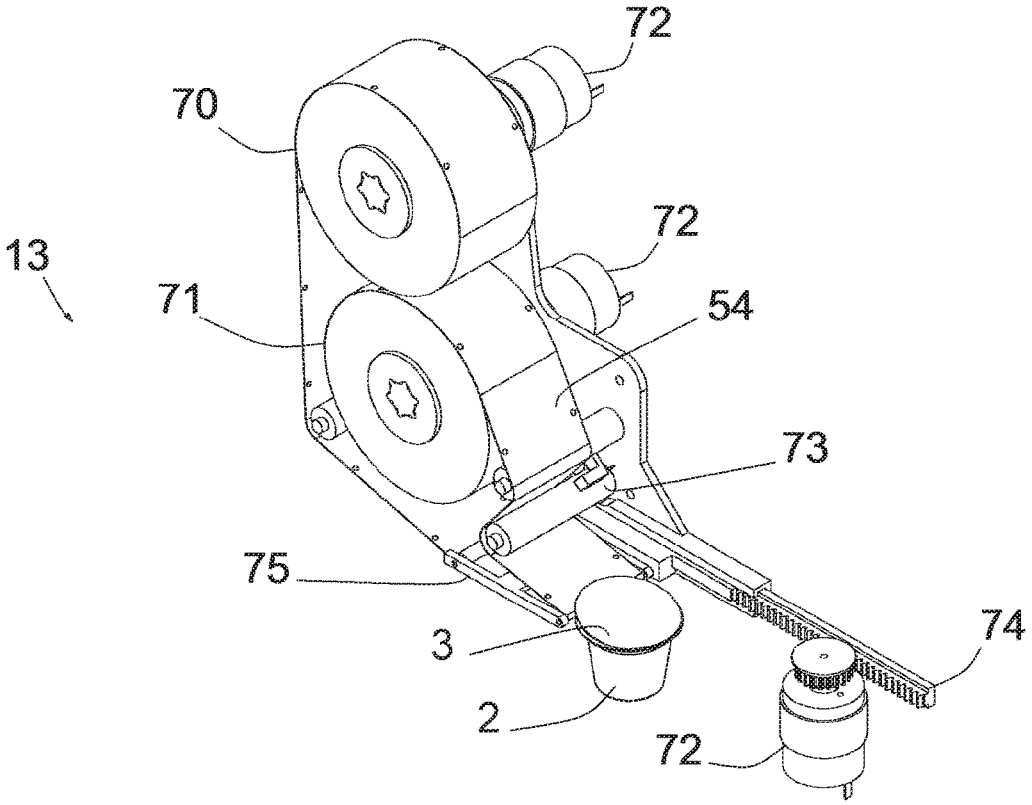

In practice, as shown in FIG. 15 and FIG. 16, the moving body of the unit 13 is positioned relative to the shell 2 by a movement along the rail 74 and by a movement of the moving part 75 such that the shell 2 is positioned below the moving part 75 such that the edges of a lid 3 correspond to the edges of the shell 2. During these operations, the drive means 72 of the two wheels 70 and 71 have the same torque, which allows a movement of the tape 54. The tape 54 is positioned correctly on the moving parts 75 using a guide element assembly 73. When the moving part 75 is positioned correctly relative to the shell 2 as shown in FIG. 16, the torque of the drive means 72 of the second wheel 71 is greater than that of the drive means 72 of the first wheel 70. Coupled with the assembly of the guide elements 73 and the movement of the moving parts 75, an acute angle is created and a tension is applied such that the lid 3 loosens from the tape 54 from the side opposite the moving body. As shown in FIG. 17, the moving body moves in the opposite direction on the rail 74 and the moving part 75 retracts such that the lid 3 ultimately loosens from the tape 54 while being set down over the course of the movement on the edges of the shell 2. The unit 13 then returns to its initial position shown in FIG. 14 to be able to begin a new cycle.

As appears from the preceding, the invention provides a machine for producing capsules intended to be used in a percolator device making it possible to produce coffee drinks, which has the deciding advantages of allowing an individual to produce his own capsules and thus to achieve substantial savings, as well as making it possible to use more environmentally friendly capsules, i.e., the component material of which is less expensive and more easily recyclable than that of the existing capsules.

What is claimed is:

1. A machine for producing capsules containing a product to be mixed with a liquid, in particular by means of a percolator device, each capsule comprising a shell for receiving the product, forming a peripheral upper rim, and a lid for closing the shell, connected to said rim; the machine comprises a module for dispensing the product and an application unit for applying lids on the shells of the capsules;

wherein:

the machine comprises a rotary plate having cavities regularly distributed over the circumference of the plate, each cavity being capable to receive the shell of a capsule and keep said shell in position on the plate; the cavities of the plate are arranged such that, when a first cavity is positioned opposite said unit for applying lids, a second cavity is situated opposite a delivery unit for delivering the shells of the capsules, comprised by the machine, a third cavity is situated opposite a filling unit for filling the shells with the product, and a fourth cavity is situated opposite a free sector of the plate, making it possible to remove the capsule present in this cavity of the plate;

said delivery unit for delivering the shells of the capsules is situated upstream relative to the dispensing module in a direction of rotation of the plate; the delivery unit comprises a storage magazine for storing the shells stacked together one in another, and a subassembly for delivering shells one by one to the plate, by gravity, such that a single shell is delivered in the second cavity of the plate located below the storage magazine;

the filling unit is situated opposite a trough for delivering product, comprised by the dispensing module; the filling unit comprises a funnel opposite which an empty shell placed in the third cavity of the plate is positioned by rotation of said plate, wherein the funnel has a lower tubular portion and a sleeve that engages around the lower tubular portion;

each shell has an inside and the funnel of the filling unit has a bottom opening, and wherein the filling unit comprises a compacting member moving in a to-and-fro motion coaxially to the funnel, through the sleeve and the bottom opening of the funnel and to the inside of the shell situated below the funnel;

the machine comprises a rotational driver that rotates the plate with cavities; and the machine comprises an automaton that coordinates with rotational driver with a subassembly driver that drives the delivery subassembly, the automaton includes a dispensing module controller, and a lid application controller that controls the application of the lids on the shells of the capsules, wherein the automaton is configured to:

detect if a positioning of a cavity is opposite to said storage magazine such that said cavity is capable of receiving the shell delivered by said delivery subassembly;

actuate the rotation of the plate until a cavity is positioned opposite the storage magazine if a cavity is not positioned opposite the storage magazine; and actuate said delivery subassembly so as to release the shell, which falls by gravity into a cavity situated below.

2. The machine for producing capsules according to claim 1, wherein:

the storage magazine has a bottom opening and contains a series of shells of capsules;

said delivery unit comprises a moving part movable in a to-and-fro movement having a movement direction, between initial position and a final position; the moving part is situated at the lower end of the storage magazine and has a first end and a second end, and two opposite sides; the moving part forms, at said first end, a receiving opening coming, in the initial position of the moving part, across from the bottom opening of the storage magazine and receiving the bottom shell from the series of shells contained in the storage magazine, said bottom shell falling into said receiving opening by gravity, and the peripheral upper rim of said bottom shell being received against two receiving surfaces formed by the moving part, situated on the two opposite sides of the moving part and parallel to the movement direction of said moving part, the two receiving surfaces lying in a plane; the moving part also forms a first guide rail situated in the plane of said receiving surfaces of the moving part, which communicates with a release opening for releasing the lower shell, situated at said second end of the moving part; the moving part also forms two side ramps having lower parts and upper parts; the lower parts of the side ramps are arranged on the side of said receiving opening, above the beginning of said first guide rail, these side ramps being situated on the two opposite sides of the moving part and being parallel to the movement direction of said moving part, so as to be able to engage below the peripheral upper rim formed by the shell that is immediately above said bottom shell, these ramps communicating with a second guide rail situated above said first guide rail; during the movement of the moving part from said initial position, the ramps make it possible to lift the series of shells situated in the storage magazine, so as to provide for the separation of said immediately higher shell with respect to said bottom shell; when the moving part arrives in the final position in which said release opening arrives opposite the opening of the storage magazine, said bottom shell falls by gravity into a cavity of the plate, through said release opening, while said immediately higher shell is retained by rims of the moving part delimiting the bottom part of said second guide rail;

said subassembly driver drives said moving part in said to-and-fro movement of said moving part, such that said moving part moves from said initial position, for receiving the bottom shell, into said final position, then returns from said final position to said initial position.

3. The machine for producing capsules according to claim 1, wherein:

the funnel has an axis;

the sleeve is coaxial to the bottom opening of the funnel, said sleeve having a bottom end and inside, and said sleeve being movable along the axis of the funnel between an upper position in which the bottom end of the sleeve is at a distance from the plate and does not hinder the rotational movement of said plate, and therefore allows the shell of a capsule to arrive opposite the bottom opening of the funnel, and a lower position in which said bottom end of the sleeve bears against the peripheral upper rim comprised by the shell and thus constitutes a continuous conduit from the inside of the sleeve to the inside of the shell.

4. The machine for producing capsules according to claim 1, wherein:

the peripheral upper rim of the shell has a diameter;

the application of the lid on said peripheral upper rim has a beginning-of-application position and an end-of-application position;

the application unit comprises a body movable relative to a support structure so as to have a mobility, this mobility being done along a travel slightly larger than the diameter of the peripheral upper rim, this travel extending between the beginning-of-application position and the end-of-application position; this body comprises, mounted thereon:

a support film for supporting the lids, these lids being self-adhesive and placed one after the other on said support film;

a stepwise advancement wheel for the stepwise advancement of the support film, the stepwise advancement of which is coordinated with the movement of said body;

an edge around which the support film is engaged, such that the sliding of the film around said edge causes the lid to be loosened with respect to the film; and adjacent said edge, an applicator for application of the lid on the peripheral upper rim of the shell.

5. The machine for producing capsules according to claim 1, wherein the application unit comprises a moving body and a movement rail, the movement rail allowing a movement of the moving body between an initial position, a beginning-of-application position of a lid and an end-of-application position of a lid;

the moving body comprises, mounted thereon:

a support film for supporting the lids, said lids being self-adhesive and placed one after the others on this support film;

a first wheel and a second wheel for advancing the support film stepwise, the stepwise advancement of the support film being coordinated with the movement of said moving body;

a set of drive means for driving the movement rail and the first and second wheels;

a set of guide means for guiding the support film, and a moving part around which the support film is engaged, such that the sliding of the support film around this moving part causes the loosening of a lid with respect to the support film.

6. The machine for producing capsules according to claim 1, wherein the cavities of the plate emerge in the periphery of said plate, which facilitates the removal of the capsules with respect to said cavities, either manually or by a mechanical device.

7. The machine for producing capsules according to claim 1, wherein the machine includes a control and management unit, comprising a memory in which a computer program is stored for remotely controlling the machine, in particular making it possible to consult the number of capsules produced, to manage the inventories of capsules and to save and use a configuration profile by types of capsules produced.

* * * * *